US005851312A

United States Patent [19]

Honkura et al.

[11] Patent Number: 5,851,312

[45] Date of Patent: Dec. 22, 1998

[54] PRODUCTION METHOD, PRODUCTION APPARATUS AND HEAT TREATMENT APPARATUS FOR ANISOTROPIC MAGNET POWDER

[75] Inventors: Yoshinobu Honkura, Chita-gun; Hironari Mitarai; Takenobu Yoshimatsu, both of Tokai, all of Japan

[73] Assignee: Aichi Steel Works, Ltd., Tokai, Japan

[21] Appl. No.: 891,498

[22] Filed: Jul. 11, 1997

Related U.S. Application Data

[62] Division of Ser. No. 607,208, Feb. 26, 1996, abandoned.

[51] Int. Cl.[6] ..... H01F 1/057

[52] U.S. Cl. ..... 148/122; 148/101; 148/105

[58] Field of Search ..... 148/101, 102, 148/103, 104, 105, 122

[56] References Cited

U.S. PATENT DOCUMENTS

| | | | |
|---|---|---|---|
| 4,981,532 | 1/1991 | Takeshita et al. | 148/302 |
| 5,338,371 | 8/1994 | Nakayama et al. | 148/101 |
| 5,354,040 | 10/1994 | Nakayama et al. | 266/252 |
| 5,580,396 | 12/1996 | Fruchart et al. | 148/101 |
| 5,609,695 | 3/1997 | Kojima et al. | 148/104 |

FOREIGN PATENT DOCUMENTS

| | | |
|---|---|---|
| 0 047 353 | 3/1982 | European Pat. Off. . |
| 0 545 644 | 6/1993 | European Pat. Off. . |
| 0 546 799 | 6/1993 | European Pat. Off. . |
| 5-163510 | 6/1993 | Japan . |
| 5-171203 | 7/1993 | Japan . |
| 5-171204 | 7/1993 | Japan . |
| 5-247528 | 9/1993 | Japan . |
| 2 094 961 | 9/1982 | United Kingdom . |
| 2 194 029 | 2/1988 | United Kingdom . |
| 2 258 468 | 2/1993 | United Kingdom . |
| 2 263 969 | 8/1993 | United Kingdom . |

*Primary Examiner*—John Sheehan
*Attorney, Agent, or Firm*—Jacobson, Price, Holman & Stern, PLLC

[57] ABSTRACT

In HDDR (hydrogenation, disproportionation, desorption and recombination) treatment, a mass production method and its apparatus for anisotropic rare earth magnet powder had not been established because it is difficult to keep a constant temperature of material due to an exothermic/endothermic reaction with hydrogen. The present invention compensates for the heat accompanied with the exothermic/endothermic reaction by a counter reaction by the use of dummy material. The apparatus includes sets of a processing vessel and a heat compensating vessel in contact and in control of their temperature. The apparatus enables the temperature control of HDDR treatment within a desired range and constantly brings out the maximum property from the material. The controlability of the method is independent of the production scale so that mass production by HDDR treatment can be set into practice.

4 Claims, 2 Drawing Sheets

HYDROGEN GAS CYLINDER
PURIFIER
TEMPERATURE CONTROL UNIT
CENTRAL CONTROL UNIT
VACUUM PUMP
VACUUM PUMP
1
2
3
4
5
6
7
10
25
27
30
31
40
45
50
51
52
53
54
56
57
58
60
61
65
66
70
71
98

PRODUCTION METHOD, PRODUCTION APPARATUS AND HEAT TREATMENT APPARATUS FOR ANISOTROPIC MAGNET POWDER

This is a divisional of application Ser. No. 08/607,208, filed Feb. 26, 1996 now abandoned.

BACKGROUND OF THE INVENTION

1. Field of the Invention

The present invention relates to a production method and its apparatus for producing anisotropic rare earth magnet materials, wherein the materials are subjected to HDDR treatment. HDDR stands for hydrogenation, disproportionation, desorption and recombination.

2. Description of the Related Art

In the process, a rare earth alloy is first prepared. Then hydrogen is occluded into the alloy by holding the material at a temperature from 500° C. to 1000° C. either in an atmosphere of hydrogen gas or a mixture of hydrogen and inert gases. Subsequently the alloy is subjected to dehydrogenation at a temperature from 500° C. to 1000° C. either in an atmosphere of hydrogen gas or a mixture of hydrogen and inert gases. Subsequently the alloy is subjected to dehydrogenation at a temperature from 500° C. to 1000° C. until the pressure of hydrogen in the atmosphere is reduced to no greater than $1\times10^{-1}$ torr, and is subjected to cooling.

Up to now rare earth magnet powder was widely used for producing bonded magnets. The major shortcoming of bonded magnets is that they have lower levels of magnetic properties as compared to sintered magnets because the bonded magnets have low density and its magnetic property is isotropic.

The improvement of bonded magnet anisotropic powders, which have much better magnetic properties than that of isotropic powders, have been under development. HDDR treatment is well known for preparation of anisotropic magnet powders.

In the treatment, the magnetic property of the powders deteriorates significantly if the treating temperature of hydrogenation or desorption slightly deviates from a very narrow optimum temperature range. Hydrogenation is an exothermic reaction, and desorption is an endothermic reaction. It is difficult to keep a constant temperature of rare earth magnet material during the hydrogenation and desorption processes because of these exothermic/endothermic reactions. It is also more difficult to carry out production in a large scale because the heat increases proportionally with the mass of the magnet material.

A thermal reservoir which is inserted together with the material into a reactive vessel is generally used to keep a desired temperature, but the temperature controlability of such a reservoir is not satisfactory for mass production.

In Japanese patent application Laid-open (Kokai) No. 5-163510, radiation heating is proposed to improve follow-up temperature control. But still the temperature controlability is not satisfactory for mass production and causes deterioration of produced magnet powder.

In Japanese patent application Laid-open (Kokai) No. 5-171203 and 5-171204, a hydrogen absorbed alloy is applied as a source of gaseous hydrogen when a rare-earth magnet is subjected to hydrogen treatment at high temperature. In this invention, the purity of the gaseous hydrogen to be subjected to the hydrogen treatment can be improved. It is possible to prevent the magnet material from being polluted by impurities contained in the gaseous hydrogen, and to prevent magnetic properties from being affected by the pollution due to impurities. However, the above technology is not satisfactory for equalizing the temperature of the rare-earth magnet material at the time of the hydrogen treatment. Furthermore, the degradation of the characteristic of the magnet occurs, caused by the deviation of the temperature of the hydrogen treatment.

Prior inventions have not succeeded in compensating for the heat generated/absorbed by exothermic/endothermic reactions with hydrogen in HDDR treatment. Consequently mass production of HDDR treated powder has not been achieved.

SUMMARY OF THE INVENTION

An object of the present invention is to offer a method to keep the temperature within a desired range in HDDR treatment by means of compensating for the heat accompanied with hydrogenation and desorption.

The principle of the present invention is to compensate for the heat accompanied with exothermic/endothermic reaction by counter reaction of dummy material. The apparatus has a set of a processing vessel and a heat compensating vessel in contact and can control their temperature in a manner similar to ordinary furnaces. Raw material is inserted in the processing vessel in which hydrogen pressure can be controlled. Dummy material is inserted in the compensating vessel also in which hydrogen pressure can be controlled independently with the processing vessel.

When an exothermic reaction occurs and the material generates heat in the processing vessel, the hydrogen pressure of the compensating vessel is decreased to start an endothermic reaction and to compensate for the generated heat in the processing vessel.

In the same manner, the hydrogen pressure is increased to compensate for absorbed heat by an endothermic reaction in the processing vessel.

The kind and amount of dummy material is chosen according to processed material to have equivalent latent heat.

The notable characteristic of the apparatus is that the processing vessel and the compensating vessel comprise a single system and require no energy transport to or from the outside of the system. The heat compensation can be controlled only by hydrogen pressure in the compensating vessel.

Now the apparatus of the present invention will be described in detail.

The apparatus consists of the processing vessel in which raw material is inserted, a heater for the processing vessel, a hydrogen supplier to the processing vessel, an evacuating system to evacuate the hydrogen from the vessel, the compensating vessel in which dummy material is inserted, and a control system for the hydrogen pressure of the compensating vessel. The processing vessel and the compensating vessel are placed in contact to form a set of vessels.

The hydrogen pressure control system consists of a temperature sensor placed in the processing vessel to detect the generation or absorption of heat, an electromagnetic three-way valve for hydrogen, and an electronic control unit.

The apparatus can have multiple sets of vessels. The number of the sets can be from two to as much as several hundred. The vessels are made of materials which have good heat conduction and small heat capacity, preferably stainless steel, because the heat transportation between the vessels would be easy.

Raw material for the present invention has magnetic property which is enhanced by HDDR treatment. The kinds of material are R-T-B type magnet, R-T-M type magnet and Sm—Fe—N type where R stands for rare earth element such as Y, La, Ce, Pr, Nd, Sm, Gd, Tb, Dy, Ho, Er, Tm, and Lu; T stands for ferrous metal such as Fe, Co, and Ni; and M stands for elements which form tetragonal ThMn12 type compounds such as Ti, V, Cr, and Mo. More than 50% of R must be Nd or Pr or both, also more than 50% of T must be Fe.

The examples of the magnet are Nd—B—Fe type, Nd—Ga—B—Fe type, Nd—Co—Ga—B—Fe type, Nd—Fe—Ti type, Nd—Fe—Ti—C type and Nd—Fe—V—C type magnet.

The dummy material must have either an exothermic or an endothermic reaction, preferably both of them. It is preferable to choose the same type as the processed raw material.

The present invention which utilizes the compensation effect of the dummy material with controlled hydrogen pressure enables the temperature control of HDDR treatment within a desired range and brings out the maximum property from the material constantly. The controlability of the method is independent of the production scale so that mass production by the HDDR treatment can be set into practice.

DETAILED DESCRIPTION OF THE PREFERRED EMBODIMENTS

Embodiments according to the present invention will be described as follows with reference to FIGS. 1 to 3.

Figure 1:
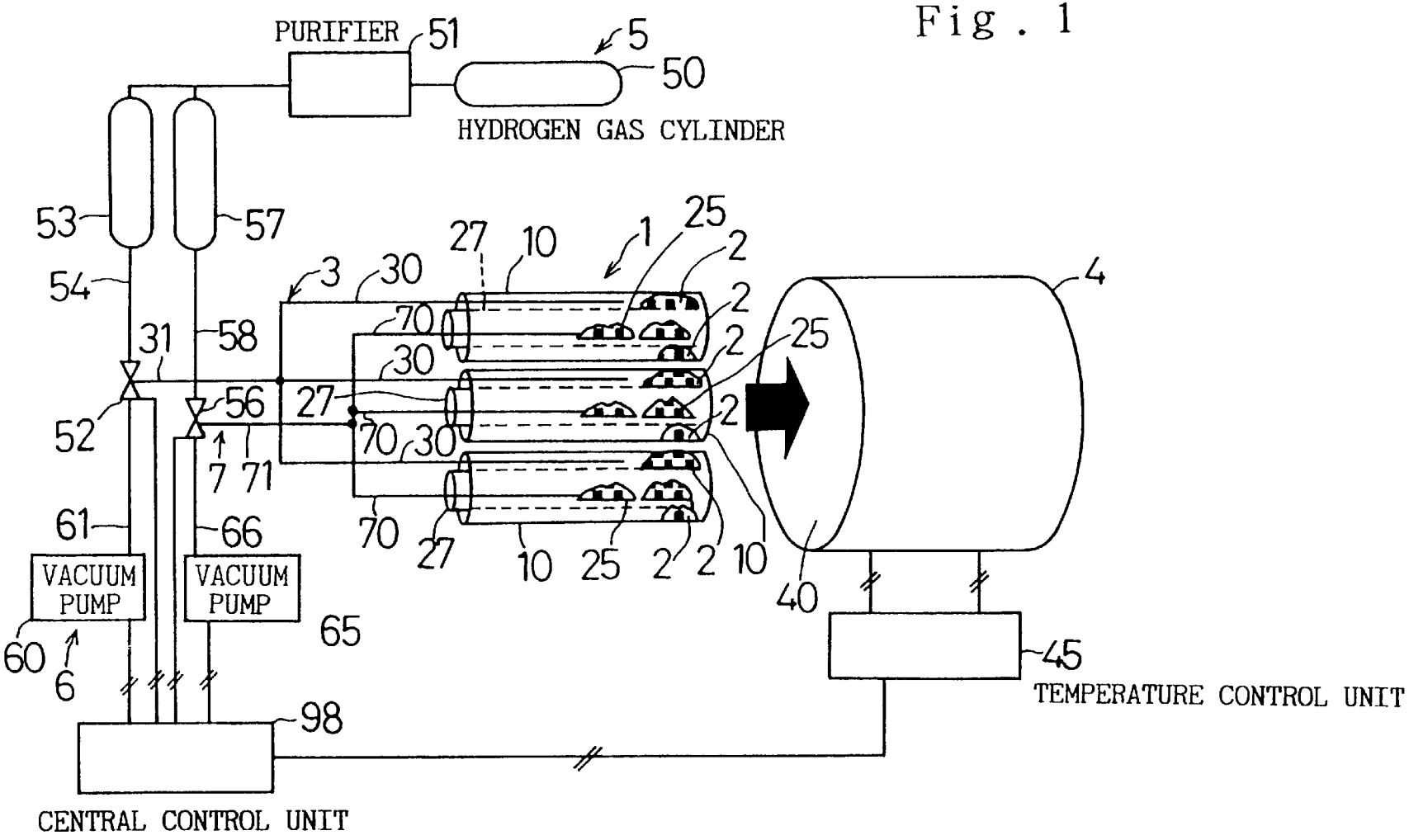
FIG. 1 shows a construction of the inventive apparatus.

The construction of the apparatus is shown in FIG. 1.

The processing vessels 1, made of stainless steel, consist of multiple tubes 10 spaced apart from each other and contain raw material 2 inside of them.

Dummy material 25 has an exothermic and an endothermic reaction with hydrogen. The same alloy as the processed material is used for dummy material 25. It is inserted in the compensating tubes 27 made of stainless steel. The compensating tubes are placed coaxially inside each processing tube 10. Processed material 2 and the dummy material 25 are placed in close proximity, separated by the tube wall.

Through junction 3 the hydrogen supply line 31 turns into branch lines 30 which are connected to each processing tube 10 for supply and evacuation of hydrogen. In this example, each set of tubes and lines is equivalent in dimension and material to keep the same temperature among the tubes.

Through junction 7, the dummy hydrogen supply line 71 turns into branch lines 70 which are connected to each compensating tube 10 for supply and evacuation of hydrogen. In this example, each set of tubes and lines is equivalent in dimension and material to keep the same temperature among the tubes.

Heater 4 is for heating of processed material 2 and dummy material 25. The temperature of heat chamber 40 is controlled by control unit 45.

Hydrogen supply unit 5 is for supplying hydrogen to both processed material and dummy material. It consists of a hydrogen gas cylinder 50, purifier 51 for purification of raw hydrogen gas, and two hydrogen supply lines. The first line is for the processing tubes and the second line is for compensating tubes.

The first line consists of hydrogen accumulator 53, electromagnetic three-way valve 52, and line 54 to connect them. The second line consists of hydrogen accumulator 57, electromagnetic three-way valve 56, and line 58 to connect them. Valve 52 and junction 3 are connected by line 31. Valve 56 and junction 7 are connected by line 71.

Evacuation system 6 is used to reduce the pressure of the processing tubes 10 and dummy tubes 27 for desorption of hydrogen from materials. It consists of two evacuating lines.

The first line is for the processing tubes and the second line is for the compensating tubes.

The first line consists of vacuum pump 60, electromagnetic three-way valve 52, and line 61 to connect them. The second line consists of vacuum pump 65, electromagnetic three-way valve 56, and line 66 to connect them.

As seen in FIG. 1, temperature control unit 45, electromagnetic three-way valves 52, 56, and vacuum pumps 60, 65 are governed by central control unit 98. Central control unit 98 controls the hydrogen pressure of the compensating vessel in accordance with the exothermic/endothermic reaction of the processed material. Thus the central unit 98 serves as moderator for heat compensation. (Hydrogenation process)

Nd—Co—Ga—B—Fe type alloy with a chemical composition of $Nd_{12.3}$, $Co_{11.5}$, $B_{6.0}$, $Ga_{1.7}$ at % and balanced with Fe and inevitable impurities is melted into an ingot. It is crushed into coarse grain with a diameter of 2 to 4 mm by preliminary hydrogenation and desorption at 250° C. The prepared material is inserted into processing tubes 10 with equal quantity for each.

Same material as dummy material 25 is inserted in the compensating tubes 27 under a hydrogen pressure of 1.2–1.5 atm. The sets of processing tube 10 and compensating tube 27 are inserted in heating chamber 40 of heater 4 so that the processed material and dummy material are heated to a set temperature.

Figure 2:
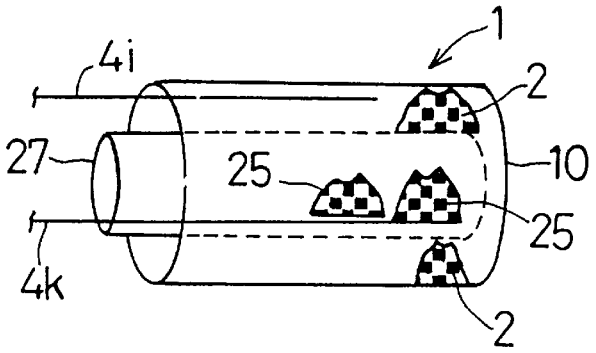
FIG. 2 is a magnified view of a set of processing and compensating tubes.

The temperatures of the processed material and the dummy material are detected by thermocouples **4*i* and 4*k*, respectively, as shown in FIG. 2**.

The central control unit disconnects the line 61 from the line 31 and connects the line 54 to line 31 by electromagnetic three-way valve 52. Hydrogen is supplied to processing tubes 10 through line 54, valve 52, line 31, and line 30.

In the hydrogenation process, the processed material absorbs hydrogen at elevated temperature in the processing tubes 10. This hydrogenation is accompanied with heat generation. Hydrogenation is carried out at a temperature of about 800° C. for 3 hours under a pressure of 1.2 to 1.5 atm.

At the same time as hydrogenation, the central control unit connects the line 66 to the line 71 and disconnects the line 58 from line 71 by electromagnetic three-way valve 56. By vacuum pump 65, hydrogen is evacuated from compensating tubes 27 through line 66, valve 56, line 71, and line 70 to the vacuum of $10^{-5}$ to $10^{-9}$ torr. In the desorption process, the dummy material desorbs hydrogen in the compensating tubes 27. This desorption is accompanied with heat absorption.

The heat absorption n the compensating tubes 27 cancels the heat generation in the processing tubes 10 to keep the temperature constant.

(Desorption Process)

After the hydrogenation step is completed, the desorption process is started.

The central control unit disconnects the line 54 from the line 31 and connects the line 61 to line 31 by electromagnetic three-way valve 52. By vacuum pump 60, hydrogen is evacuated from processing tubes 10 at a vacuum of $10^{-5}$ to $10^{-9}$ torr. The processed material desorbs hydrogen in the processing tubes 10. This desorption is accompanied with heat absorption.

Desorption is carried out at a temperature of 775° to 800° C. for 30 minutes.

At the same time with desorption, the central control unit 98 disconnects the line 66 from the line 71 and connects the line 58 to line 71 by electromagnetic three-way valve 56. Hydrogen is supplied to compensating tubes 27 through line 58, valve 56, line 71, and line 70. The dummy material absorbs hydrogen. This absorption is accompanied with heat generation.

The heat generation in the compensating tubes 27 cancels the heat absorption in the processing tubes 10 to keep the temperature constant.

After the desorption step is completed, the material is quenched in cooling gas, such as argon, or with cooling water as the final process. The cooling can be done directly to the material or from outside of the processing tube.

By the process described above, an anisotropic magnet powder with improved magnetic property is produced.

The embodiment enables the temperature control of HDDR treatment within a desired range and constantly brings out the maximum property from the material. The controlability of the embodiment is independent of the production scale so that mass production by the HDDR treatment can be set into practice.

In this embodiment the material is divided into small amounts for each processing tube and is placed in close contact with the compensating tube. Each set of tubes are spaced apart by a sufficient distance to avoid interaction.

Furthermore the latent heat of dummy material is controlled to be the same for the processed material so that the cancellation is done without any surplus heat.

Thus the temperature deviation caused by the exothermic/endothermic reaction can be suppressed to a very low level.

Figure 3:
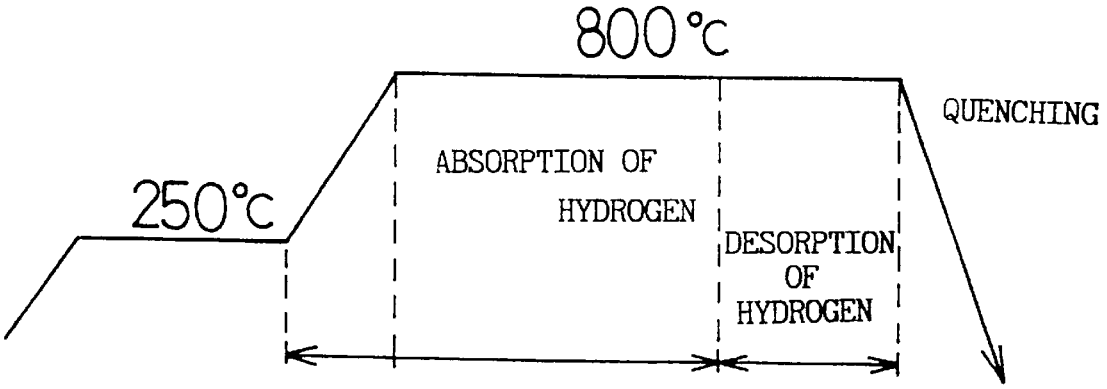
FIG. 3 shows a heat pattern for HDDR treatment.

In FIG. 3, the heat pattern of the processed material 2 is shown schematically.

In the pattern, the ingot material is pre-treated by hydrogenation and desorption at 250° C. to form a coarse-grain, then hydrogenation and desorption are carried out at near 800° C.

It is possible that the material is cooled to room temperature after pre-treatment and subjected to hydrogenation and desorption at near 800° C.

What is claimed is:

1. A method for producing anisotropic rare earth magnet powders subjected to hydrogenation, disproportionation, desorption and recombination treatment at an elevated temperature, said method comprising the steps of hydrogenation accompanied by heat generation and hydrogen desorption accompanied by heat absorption, and compensating for the generated heat accompanied with the hydrogenation or compensating for the absorbed heat accompanied with the hydrogen desorption of raw materials of said anisotopic raw rare earth magnet powders by a same amount of heat generated by synchronized counter reaction of a dummy material, said dummy material having an exothermic or endothermic property, respectively.

2. A production method as set forth claim 1, wherein said dummy material to compensate for generated or absorbed heat has a similar chemical composition to said raw materials.

3. A production method as set forth claim 2, wherein both of the generated heat accompanied with said hydrogenation and absorbed heat accompanied with said hydrogen desorption of said raw materials are compensated for by a same amount of heat generated by synchronized counter reaction of said dummy material.

4. A production method as set forth claim 3, wherein the amount of the dummy material is adjusted to be the same amount of said raw materials.

* * * * *